US006108904A

United States Patent [19]

Brekosky et al.

[11] Patent Number: 6,108,904

[45] Date of Patent: Aug. 29, 2000

[54] TOOL FOR ALIGNING A RIBBON CABLE TO A CONNECTOR

[75] Inventors: Lawrence John Brekosky, Dillsburg; David Lynn Meyer, Jonestown, both of Pa.

[73] Assignee: The Whitaker Corporation, Wilmington, Del.

[21] Appl. No.: 08/984,555

[22] Filed: Dec. 3, 1997

Related U.S. Application Data

[60] Provisional application No. 60/033,393, Dec. 17, 1996.

[51] Int. Cl.[7] ..... H01K 3/10; H01R 43/00

[52] U.S. Cl. ..... 29/854; 29/749; 29/753

[58] Field of Search ..... 29/748, 749, 753, 29/754, 760, 865, 866, 854

[56] References Cited

U.S. PATENT DOCUMENTS

| | | | |
|---|---|---|---|
| 3,866,292 | 2/1975 | Tucci | 29/203 |
| 4,005,518 | 2/1977 | Bakermans | 29/72 |
| 4,020,540 | 5/1977 | Casciotti et al. | 29/749 |
| 4,551,893 | 11/1985 | Ikeda et al. | 29/33 M |
| 4,594,776 | 6/1986 | Anderson | 29/749 |
| 4,839,962 | 6/1989 | Long, Jr. | 29/749 |
| 4,974,311 | 12/1990 | Tran | 29/566.3 |
| 5,363,549 | 11/1994 | Hecker | 29/742 |
| 5,465,479 | 11/1995 | Bowen et al. | 29/749 |

FOREIGN PATENT DOCUMENTS

| | | | |
|---|---|---|---|
| 0 099 684 A1 | 2/1984 | European Pat. Off. | H01R 43/00 |
| 1-186577 | 7/1989 | Japan | 29/748 |
| WO 92/14284 | 8/1992 | WIPO | H01R 43/04 |

OTHER PUBLICATIONS

AMP Instruction Sheet 408–4233, "Connector–Specific Kit 679235–2 for Amplimite .050 Series Plug and Receptacle Connectors"; three pages; Mar. 1996; AMP Incorporated, Harrisburg, PA.

European Search Report, Application No. EP 97 30 9962, Date of Completion, Dec. 2, 1998.

AMP Instruction Sheet 408–4201, "Base Assembly Universal Arbor Tool 768338–4" Mar. 1996, AMP Inc. pp. 1–6.

*Primary Examiner*—Lee Young
*Assistant Examiner*—Bobby Rushing, Jr.

[57] ABSTRACT

An alignment tool (44) is disclosed for aligning the conductors of a ribbon cable (12) to insulation displacement contacts (162, 168, 172) of a connector (16, 18, 14) during termination of the connector to the cable. The tool includes a body (46) having a fluted cable guiding surface (72, 74) and first and second connector receiving cutouts (66, 68) on opposite sides of the guide surface. A retaining plate (112) is hingedly attached to the body (46) and is arranged to releasable hold the ribbon cable (12) in located engagement with the fluted guide surface (72, 74). The retaining plate (112) enables the ribbon cable (12) to move longitudinally to position it for termination of a connector (14, 16, 18) without loosening the retaining plate (112) and without disturbing the alignment of the ribbon cable.

25 Claims, 6 Drawing Sheets

TOOL FOR ALIGNING A RIBBON CABLE TO A CONNECTOR

This application claims benefit of provisional application 60/033,393, filed Dec. 17, 1996.

FIELD OF THE INVENTION

The present invention relates to the termination of conductors of a ribbon cable to insulation displacement contacts in a connector and more particularly to a tool for accurately aligning the ribbon cable to the connector prior to and during termination.

BACKGROUND OF THE INVENTION

Cable assemblies of the type having ribbon or flat cable generally take the form shown in FIG. 1. There, a ribbon cable assembly 10 is shown including a length of ribbon cable 12 consisting of a number of insulated conductors arranged side by side, a receptacle connector 14 terminated at one end, a plug connector 16 terminated at the other end, and another plug connector 18 terminated at a position intermediate the other two connectors. The connectors 14, 16, and 18 are of the type having insulation displacement contacts arranged on 0.025 inch centers, and the conductors of the ribbon cable are also arranged on 0.025 inch centers. While the cable assembly 10, in the present example, has one receptacle connector and two plug connectors, the actual number of each type of connector and the distances between them will vary depending upon the application. The accurate alignment of the ribbon cable to the insulation displacement contacts prior to the actual termination operation is critical. This is usually accomplished by means of a tool such as the tool 20 shown in FIG. 2. The tool 20 consists of a block 22 having an adjustable cavity or nest 24 sized and shaped to closely receive the connector to be terminated. The plug connectors 16 and 18 require one block with a conforming nest 24 and the receptacle connector 14 requires another block with a different conforming nest. The upper surface 26 includes a series of side by side flutes 28 that run the length of the upper surface and are space to conform to the spacing of the conductors of the ribbon cable 12. The flutes 28 are arranged at right angles to the longitudinal axis 30 of the nest 24. A pair of clamping bars 32 are hingedly attached to the block 22 at the points 34 and have latches 36 that latchingly engage catches 38 to hold a ribbon cable 12 tightly against the flutes 28. When the connector is in position within the nest and a ribbon cable is properly clamped against the flutes, the nest is adjustable and is moved to align the cable and connector for each conductor of the cable to be in alignment with a respective one of the insulation displacement contacts of the connector. When making the cable assembly 10, shown in FIG. 1, after terminating the connector 16, the clamping bars 32 must be released and the cable 12 repositioned in the flutes and the clamping bars again latched in clamping position for terminating the connector 18. Additionally, the cable 12 must be clamped in a different tool for terminating the connector 14. This procedure is time consuming and is prone to the commission of inadvertent errors by the operator, such as misalignment of the cable 12 within the flutes 28 and then tightening the clamping bars 32, thereby producing a defective termination and perhaps damaging the delicate ribbon cable.

What is needed is a relatively low cost single tool that can be used to align the cable 12 for terminating both plug and receptacle connectors on the ends of the cable as well as intermediately spaced connectors without removing the cable from the tool and without loosening the clamping bars until all desired connectors are terminated to the cable and the cable assembly is completed.

SUMMARY OF THE INVENTION

An alignment tool is disclosed for aligning a ribbon cable having a plurality of conductors to a connector having a plurality of insulation displacement contacts so that each conductor is in alignment with a respective one of the plurality of insulation displacement contacts for termination thereto. The alignment tool includes a body having a longitudinal axis and first and second connector receiving cavities on opposite sides of the axis. The body includes a cable guide surface having a plurality of flutes formed therein perpendicular to the axis. A first locating surface is disposed adjacent one end of the first cavity and is arranged to position a first connector therein with respect to the flutes. A second locating surface is adjacent one end of the second cavity and is arranged to position a second connector therein with respect to the flutes, wherein the second connector is different from the first connector. A retaining plate is coupled to the body and arranged to urge a portion of the ribbon cable into aligned engagement with the flutes so that the plurality of conductors are perpendicular to the longitudinal axis.

An embodiment of the present invention will now be described by way of example with reference to the accompanying drawings.

DESCRIPTION OF THE PREFERRED EMBODIMENT

Figure 1:
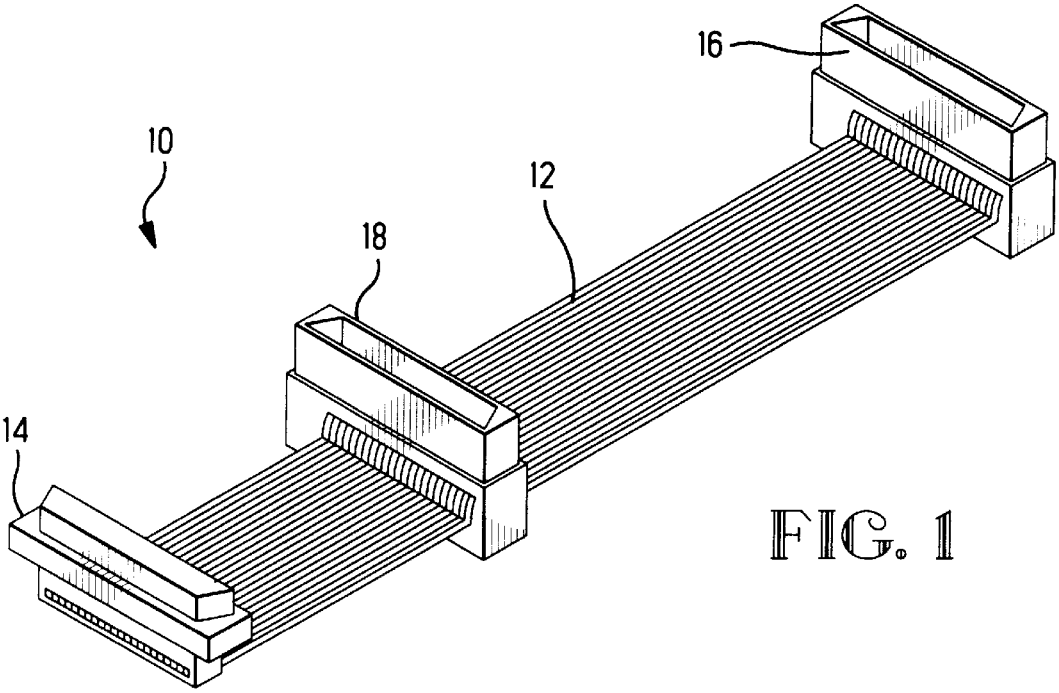
FIG. 1 is an isometric view of a ribbon cable assembly.
Figure 2:
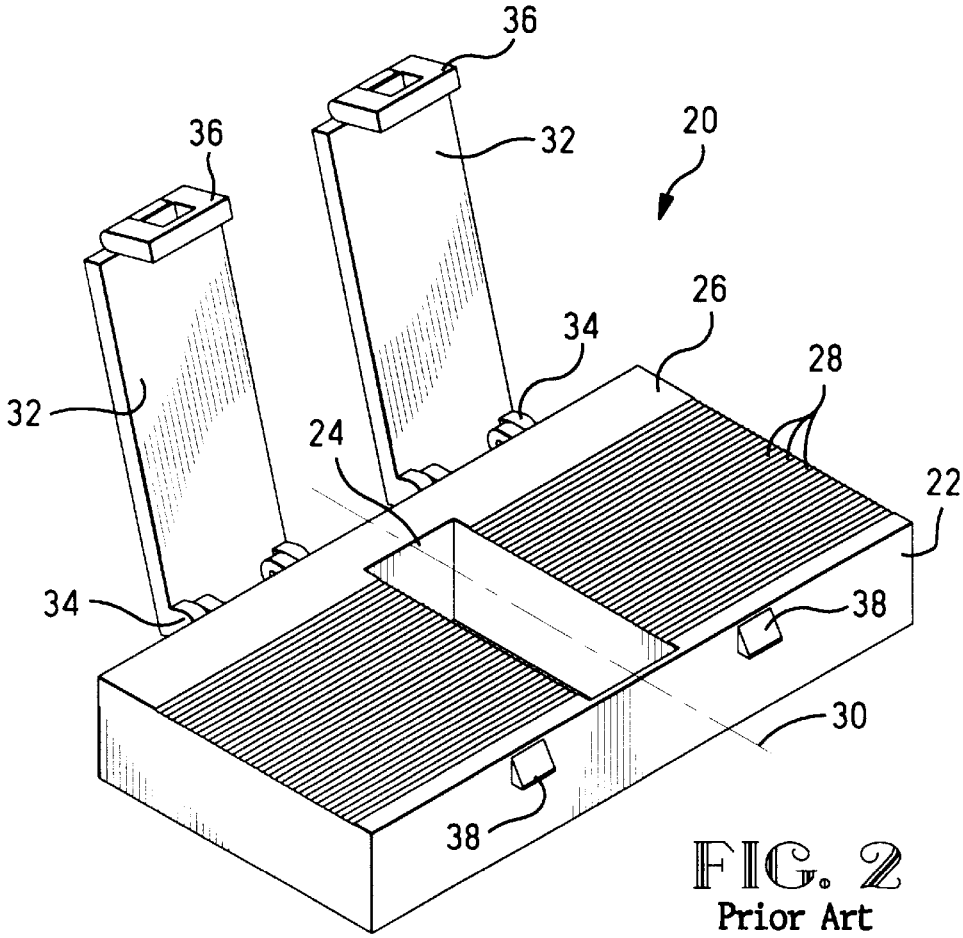
FIG. 2 Prior Art
FIG. 2 is an isometric view depicting a prior art tool for aligning a ribbon cable and connector.
Figure 3:
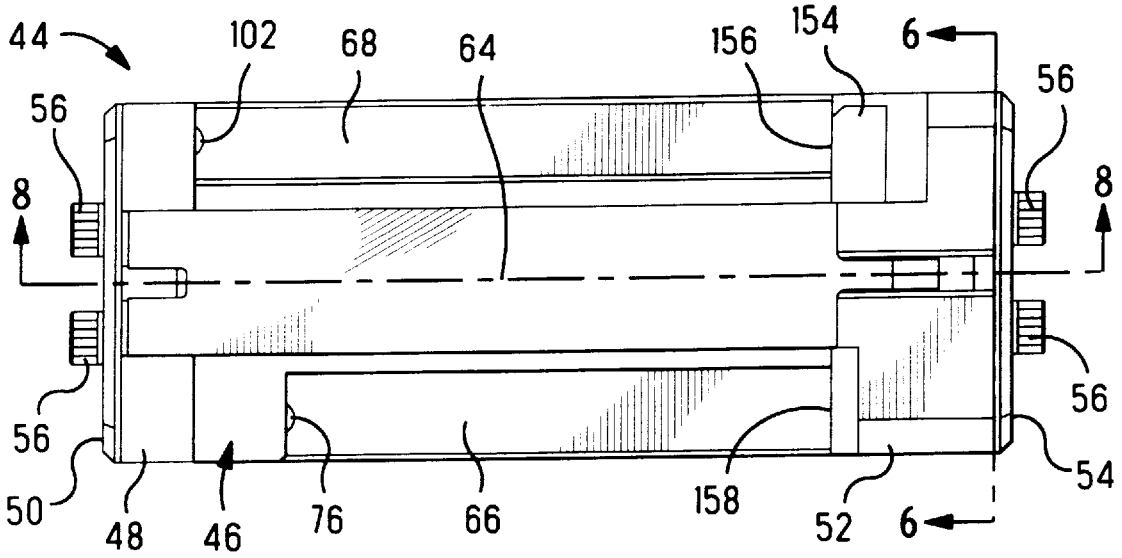
FIGS. 3, 4, and 5 are top, front, and end views, respectively, of an alignment tool incorporating the teachings of the present invention.
Figure 4:
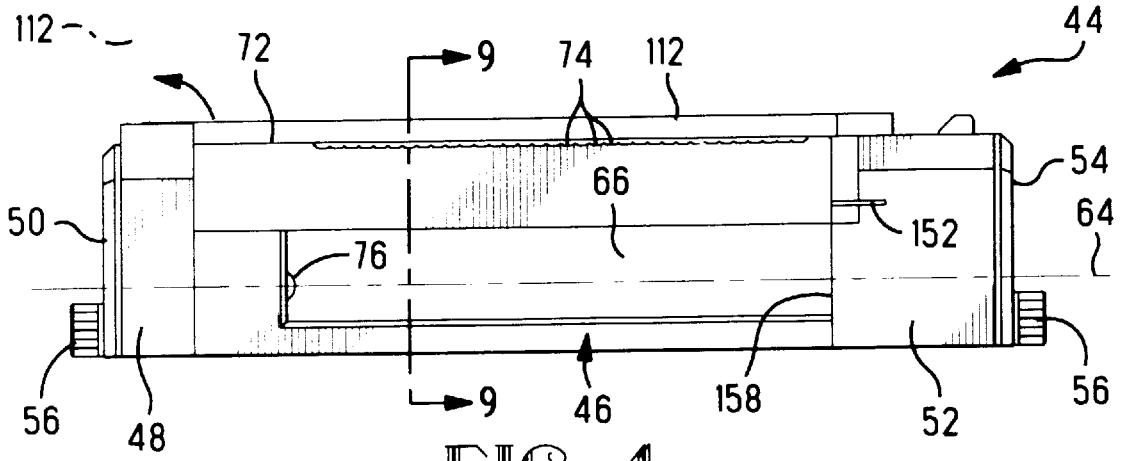
Figure 5:
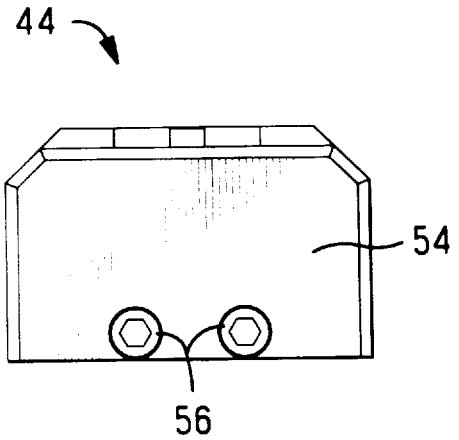
Figure 6:
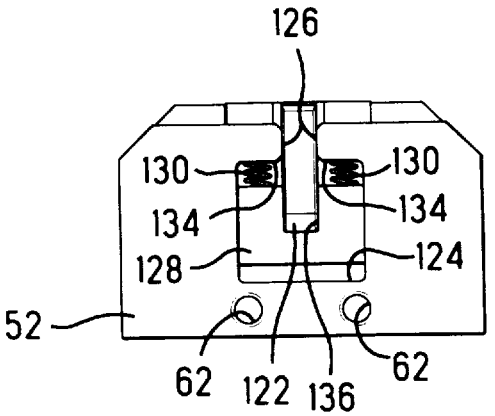
FIG. 6 is a cross-sectional view taken along the lines 6—6 in FIG. 3.
Figure 7:
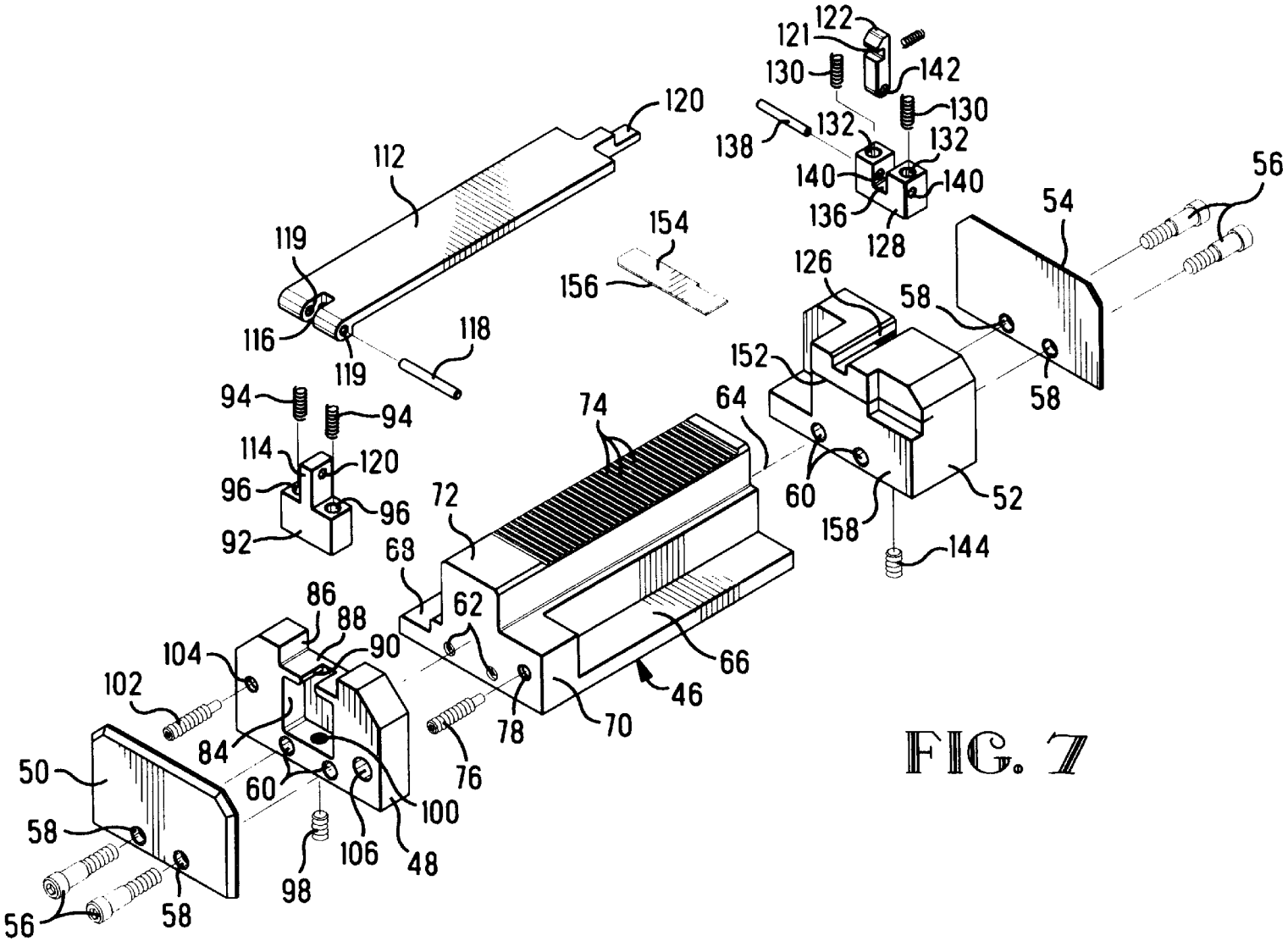
FIG. 7 is an exploded parts view of the tool shown in FIG. 4.

There is shown in FIGS. 3, 4, and 5, an alignment tool 44 having a body 46, a left end cap 48 and left cover plate 50 attached to the left end of the body, and a right end cap 52 and right cover plate 54 attached to the right end of the body. The end caps and cover plates are attached by means of screws 56 that extend through clearance holes 58 in the covers, clearance holes 60 in the end plates, and into threaded holes 62 in the body 48, as best seen in FIGS. 6 and 7. The body 46 includes a longitudinal axis 64 and first and second cutouts 66 and 68, respectively, that extend parallel to and on opposite sides of the longitudinal axis. The second cutout 68 extends the full length of the body 46 while the first cutout leaves a wall 70 adjacent the left end cap 48. With the left and right end caps 48 and 52 attached to the body 46, as shown in FIGS. 3 and 4, the first cutout 66 forms a cavity for receiving a plug connector 16 or 18, and the second cutout 68 forms a cavity for receiving a receptacle connector 14. The body 46 includes a cable guiding surface 72 that is vertically above and between the first and second cutouts 66 and 68. The surface 72 is parallel to the longitudinal axis 64 and includes a series of spaced flutes 74 formed therein perpendicular to the axis 64. The spacing of the flutes corresponds to the spacing of the conductors of the ribbon cable 12 and are sized to closely receive the outer contour of the cable. A ball plunger 76, as best seen in FIG. 7, is disposed in a threaded hole 78 that extend through the wall 70 of the body 46 so that the end of the ball plunger enters into the cutout 66, for a purpose that will be explained.

As best seen in FIG. 7, the left end cap 48 includes a rectangular blind hole 84 formed therein and a cutout 86 vertically above the rectangular hole that leaves a web 88 therebetween. A notch 90 is formed in the web 88 thereby interconnecting the cutout 86 and rectangular hole 84. A first slide member 92 is disposed within the rectangular hole 84 and is arranged to slide vertically therein. A pair of springs 94 are arranged in two blind holes 96 in the first slide member 92 so that they engage the under surfaces of the web 88 thereby urging the first slide member downwardly in the rectangular hole 84, as viewed in FIGS. 7, and 8. A set screw 98 is arranged in a threaded hole 100 formed in the bottom of the left end cap 48 so that it engaged a lower surface of the first slide member 92 for adjusting the slide member vertically within the rectangular hole, for a purpose that will be explained below. Another ball plunger 102 is disposed in a threaded hole 104 that extends through the left end cap 48 so that the end of the ball plunger enters into the cutout 68, for a purpose that will be explained. A clearance hole 106 is formed through the left end cap 48 in alignment with the ball plunger 76 so that the ball plunger can be adjusted when the end cap is in place.

Figure 8:
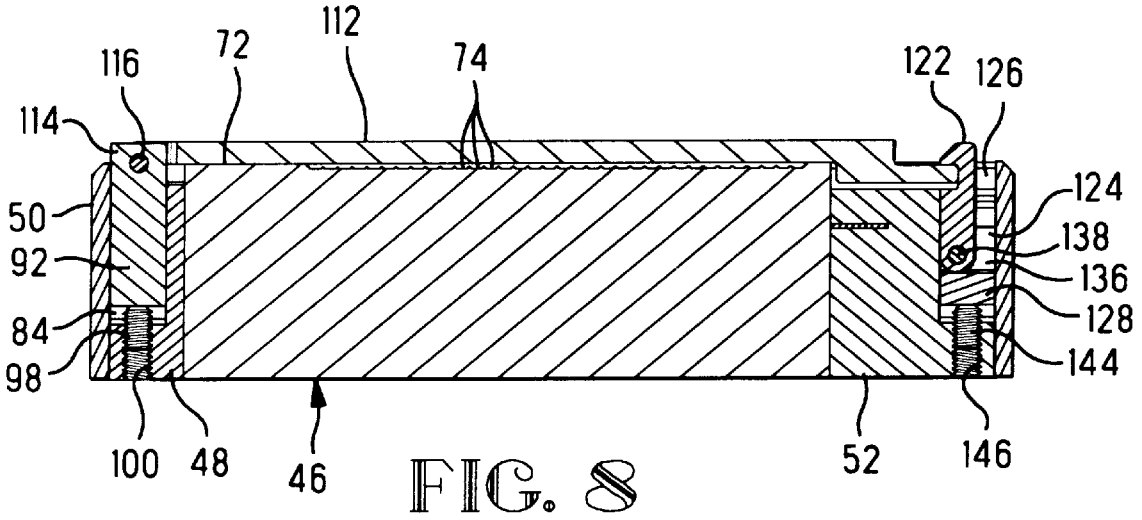
FIG. 8 is a cross-sectional view taken along the lines 8—8 in FIG. 3.
Figure 9:
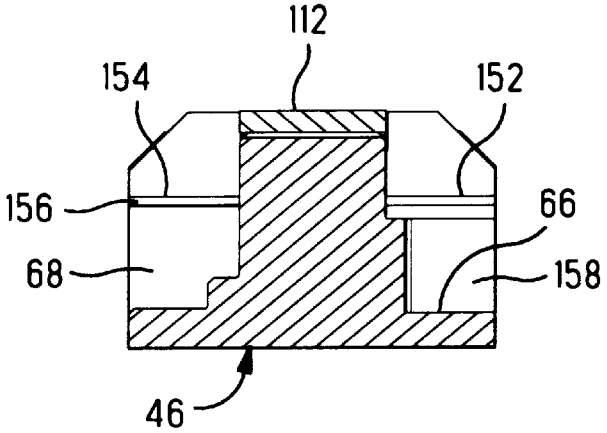
FIG. 9 is a cross-sectional view taken along the lines 9—9 in FIG. 4.
Figure 10:
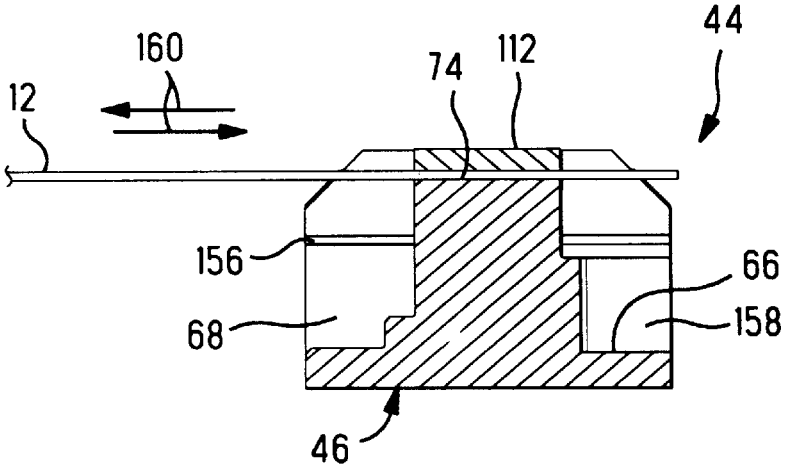
FIGS. 10 through 14 are views similar to that of FIG. 9 showing the tool in various stages of operation.
Figure 11:
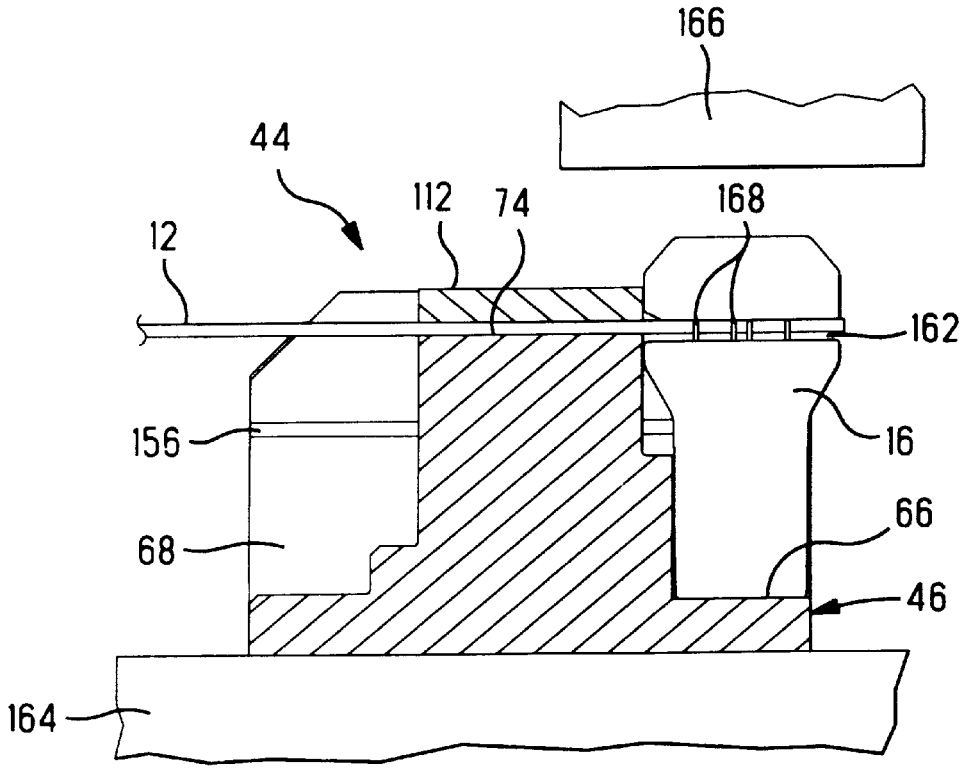

An elongated retaining plate 112 has one end hingedly attached to the first slide member 92 so that the plate can be hinged into a position that is close to and parallel with the cable guiding surface 72, as shown in FIGS. 4, 6, and 9. The first slide member has a flange 114 extending upwardly therefrom, through the notch 90, and into a notch 116 formed in the end of the retaining plate. A hinge pin 118 extends through holes 119 in the retaining plate 112 and a hole 120 in the flange 114. The other end of the elongated retaining plate 112 has a catch 120 extending therefrom that latchingly engages a notch 121 formed in a latch member 122 that is coupled to the right end cap 52. As best seen in FIGS. 6, 7, and 8, the right end cap 52 has a rectangular blind hole 124 formed therein and a narrow slot 126 vertically above and intersecting with the rectangular hole. A second slide member 128 is disposed within the rectangular hole 124 and is arranged to slide vertically therein. A pair of springs 130 are arranged in two blind holes 132 in the second slide member 128 so that they engage the upper surfaces 134 of the rectangular hole 124 thereby urging the second slide member downwardly in the rectangular hole, as viewed in FIG. 8. A slot 136 is formed through the second slide member 128 and is sized for receiving an end of the latch member 122, as shown in FIGS. 6, 7, and 8. A pivot pin 138 extends through two slip fit holes 140 in the second slide member and a slip fit hole 142 in the latch member 122. As shown in FIG. 8, a set screw 144 is arranged in a threaded hole 146 formed in the bottom of the right end cap 52 so that it engaged a lower surface of the second slide member 128 for adjusting the slide member vertically within the rectangular hole, for a purpose that will be explained below.

The right end cap 52 includes a slit 152 formed therein, as best seen in FIGS. 4, 7, and 9. A relatively thin locating blade 154 is disposed in the slit 152 so that the blade extends into the second cutout 68, as shown in FIGS. 3 and 9. The locating blade has a locating edge 156 for accurately positioning the receptacle connector 14 with respect to the flutes 74 when the connector is in position within the cutout 68. The ball plunger 102 is positioned within the threaded hole 104 so that the plunger engages and urges the receptacle connector against the locating edge 156. The right end cap 52 includes a locating surface 158 for accurately positioning the plug connectors 16 and 18 with respect to the flutes 74 when each connector is in position within the cutout 66. The ball plunger 76 is positioned within the threaded hole 78 so that the plunger engages and urges the plug connector against the locating surface 158.

Figure 12:
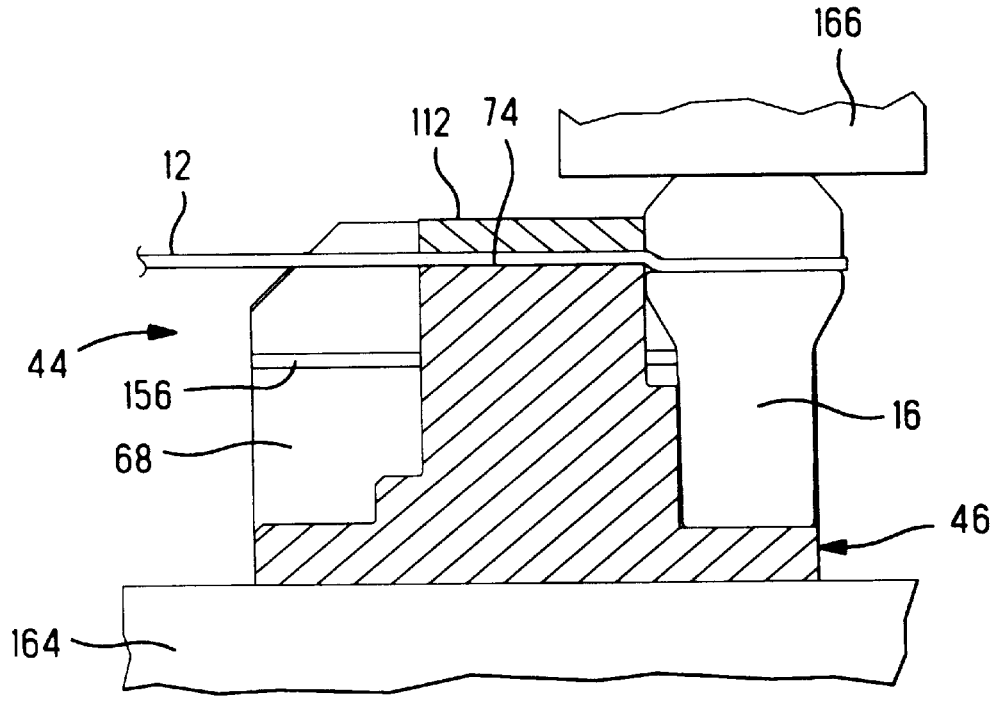
Figure 13:
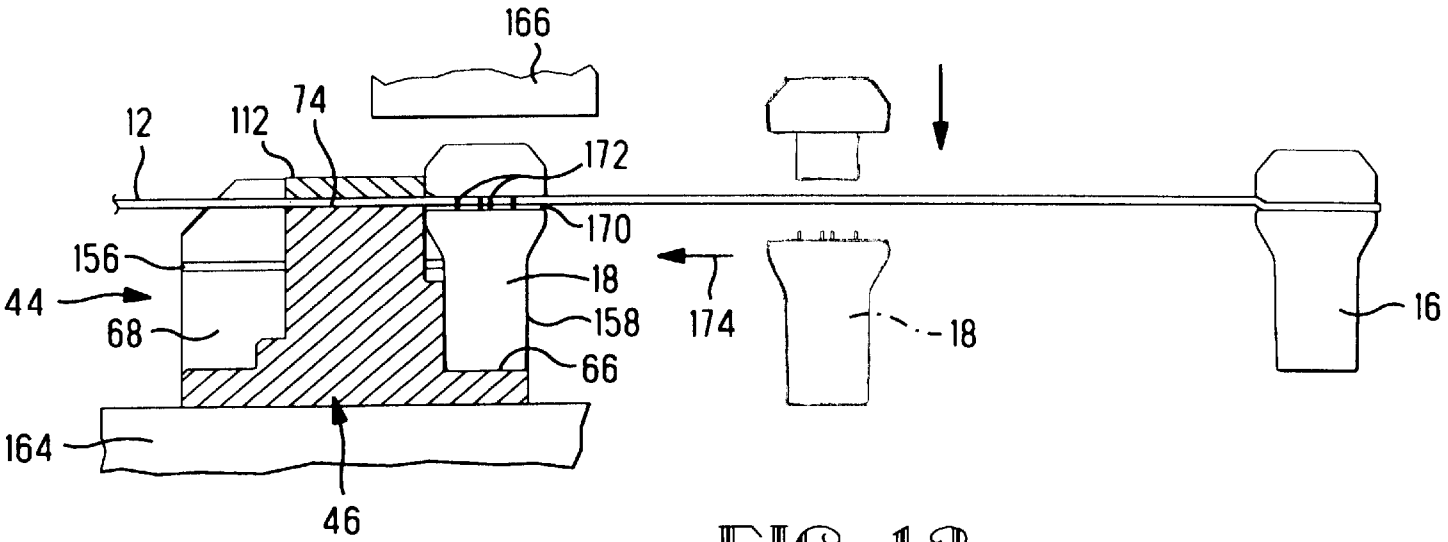
Figure 14:
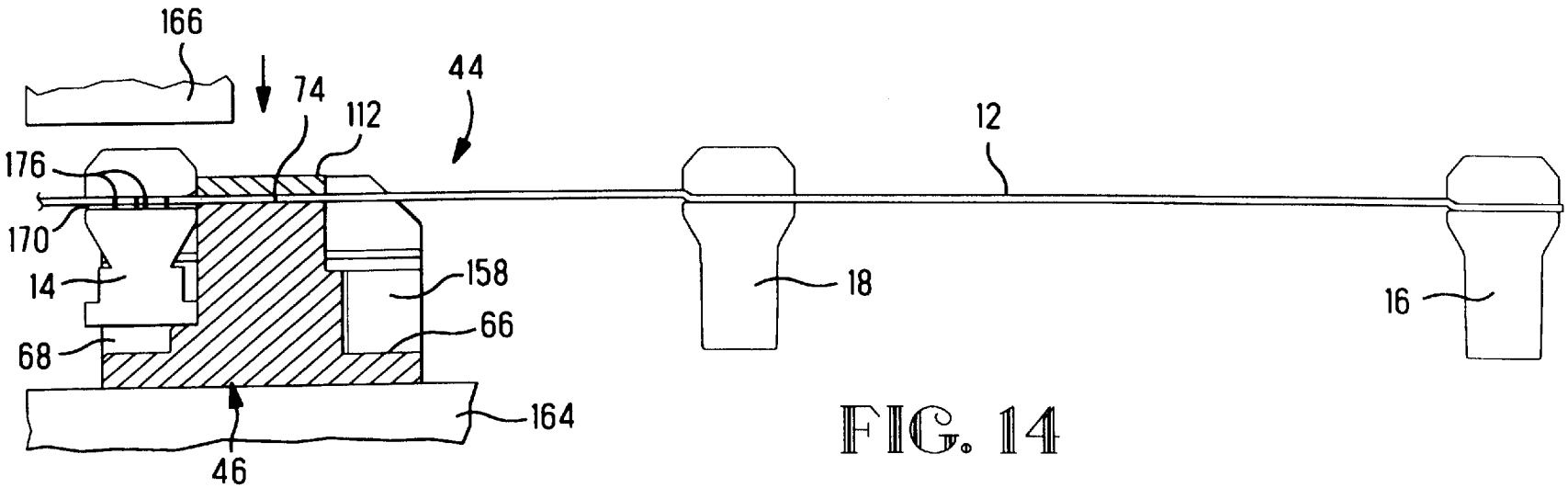

The operation of the tool 44 will now be described with reference to FIGS. 1, 4, and 10 through 14. The retaining plate 112 is opened to the position shown in phantom lines in FIG. 4, the ribbon cable 12 aligned with the flutes 74, and the retaining plate closed so that the catch 120 latchingly engages the latch member 122. At this point, if necessary, the set screws 98 and 144 are adjusted to position the retaining plate 112 vertically with respect to the flutes 74 so that the ribbon cable can be moved lengthwise, or longitudinally, through the flutes in the directions of the arrows 160 in FIG. 10, but with resistance. While the ribbon cable is longitudinally movable it remains square and accurately located within the flutes with respect to the locating edge 156 and the locating surface 158. The end of the ribbon cable 112 is threaded into the cable opening 162 in the plug connector 16 as the connector is inserted into the cutout 66. An end of the plug connector 16 is urged against the locating surface 158 by the ball plunger 76 and held in the position shown in FIG. 11. At this point each of the conductors of the ribbon cable is in alignment with a respective one of the insulation displacement contacts 168. The alignment tool 44 is then placed in a press 164 having a movable ram 166 and positioned with the plug connector 14 directly under the ram. The ram is then cycled downwardly to close the plug connector thereby terminating the conductors of the ribbon cable 12 to the insulation displacement contacts 168 of the connector 16, as shown in FIG. 12. The ram 166 is then retracted and the ribbon cable 12 is moved through the flutes 74 toward the right, as viewed in FIG. 12, to the position shown in FIG. 13. The two parts of the plug connector 18 are then separated and assembled to an intermediate portion of the cable 12, as shown in phantom lines in FIG. 13, and then moved in the direction of the arrow 174 into the cutout 66 so that an end of the connector is urged against the locating surface 158 by the ball plunger 76. At this point each of the conductors of the ribbon cable is in alignment with a respective one of the insulation displacement contacts 172 of the plug connector 18. The alignment tool 44 is positioned with the plug connector 18 directly under the ram 166. The ram is then cycled downwardly to close the plug connector 18 thereby terminating the conductors of the ribbon cable 12 to the insulation displacement contacts 172 of the connector. The ram 166 is then retracted and the ribbon cable 12 is again moved through the flutes 74 toward the right, as viewed in FIG. 13, to the position shown in FIG. 14. The other end of the ribbon cable 12 is threaded through the cable opening 170 of the receptacle connector 14 and the receptacle connector inserted into the cutout 68 so that an end of the connector is urged against the locating edge 156 by the ball plunger 102. At this point each of the conductors of the ribbon cable is in alignment with a respective one of the insulation displacement contacts 176 of the receptacle connector 14. The alignment tool 44 is again positioned with the receptacle connector 14 directly under the ram 166. The ram is then cycled downwardly to close the receptacle connector 14 thereby terminating the conductors of the ribbon cable 12 to the insulation displacement contacts 176 of the connector. The ram 166 is then retracted, the retaining plate 112 unlatched and hinged to its open position shown in phantom lines in FIG. 4, and the completed cable assembly 10 removed.

An important advantage of the present invention is that once the ribbon cable is aligned within the flutes and the retaining plate closed and latched, the cable can be moved longitudinally to position it for termination of all connectors without removing it from the tool and without disturbing the alignment by loosening the retaining plate. This significantly reduces the time required to terminate the connectors to the ribbon cable and increases the reliability of the finished cable assembly by reducing the incidence of inadvertent misalignment of the cable. Misalignment is reduced since the ribbon cable need only be aligned once, and proper alignment is apparent when the ribbon cable is observed to slide longitudinally within the flutes with the proper resistance.

What is claimed is:

1. A tool for aligning a ribbon cable having a plurality of conductors to a connector having a plurality of insulation displacement contacts so that each said conductor is in alignment with a respective one of said plurality of insulation displacement contacts for termination thereto, comprising:

(a) a body having a longitudinal axis and first and second connector receiving cavities on opposite sides of said axis, said first and second connector receiving cavities being dimensionally different in size from each other;

(b) a cable guide surface on said body having a plurality of flutes formed therein perpendicular to said axis;

(c) a first locating surface adjacent one end of said first cavity arranged to position a first connector therein with respect to said flutes;

(d) a second locating surface adjacent one end of said second cavity arranged to position a second connector therein with respect to said flutes, said second connector being dimensionally different in size from said first connector; and (e) a retaining plate coupled to said body arranged to urge a portion of said ribbon cable into aligned engagement with said flutes so that said plurality of conductors are perpendicular to said longitudinal axis.

2. A tool for aligning a ribbon cable having a plurality of conductors to a connector having a plurality of insulation displacement contacts so that each said conductor is in alignment with a respective one of said plurality of insulation displacement contacts for termination thereto, comprising:

(a) a body having a longitudinal axis and first and second connector receiving cavities on opposite sides of said axis;

(b) a cable guide surface on said body having a plurality of flutes formed therein perpendicular to said axis;

(c) a first locating surface adjacent one end of said first cavity arranged to position a first connector therein with respect to said flutes;

(d) a second locating surface adjacent one end of said second cavity arranged to position a second connector therein with respect to said flutes, said second connector being different from said first connector; and (e) a retaining slate coupled to said body by means of a pivotal attachment to a first end of said body and a releasable latch for latching to a second end of said body and arranged to urge a portion of said ribbon cable into aligned engagement with said flutes so that said plurality of conductors are perpendicular to said longitudinal axis.

3. A tool for aligning a ribbon cable having a plurality of conductors to a connector having a plurality of insulation displacement contacts so that each said conductor is in alignment with a respective one of said plurality of insulation displacement contacts for termination thereto, comprising:

(a) a body having a longitudinal axis and first and second connector receiving cavities on opposite sides of said axis, said first and second connector receiving cavities being dimensionally different in size from each other;

(b) a cable guide surface on said body having a plurality of flutes formed therein perpendicular to said axis, (c) a first locating surface adjacent one end of said first cavity arranged to position a first connector therein with respect to said flutes;

(d) a second locating surface adjacent one end of said second cavity arranged to position a second connector therein with respect to said flutes, said second connector being dimensionally different in size from said first connector;

(e) a retaining plate coupled to said body arranged to urge a portion of said ribbon cable into aligned engagement with said flutes so that said plurality of conductors are perpendicular to said longitudinal axis; and (f) resilient means arranged to urge said retaining plate toward said cable guide surface.

4. A tool for aligning a ribbon cable having a plurality of conductors to a connector having a plurality of insulation displacement contacts so that each said conductor is in alignment with a respective one of said plurality of insulation displacement contacts for termination thereto, comprising:

(a) a body having a longitudinal axis and first and second connector receiving cavities on opposite sides of said axis, said first and second connector receiving cavities being dimensionally different in size from each other;

(b) a cable guide surface on said body having a plurality of flutes formed therein perpendicular to said axis;

(c) a first locating surface adjacent one end of said first cavity arranged to position a first connector therein with respect to said flutes;

(d) a second locating surface adjacent one end of said second cavity arranged to position a second connector therein with respect to said flutes said second connector being dimensionally different in size from said first connector; and (e) a retaining plate coupled to said body by means of a pivotal attachment to a first end of said body and a releasable latch for latching to a second end of said body and arranged to urge a portion of said ribbon cable into aligned engagement with said flutes so that said plurality of conductors are perpendicular to said longitudinal axis, wherein said pivotal attachment comprises a first slide member in sliding engagement with said body and arranged to slide along a first path perpendicular to said cable guide surface and a pin extending through a portion of said first slide member and a portion of said retaining plate.

5. The tool according to claim 4 wherein said releasable latch comprises a second slide member in sliding engagement with said body and arranged to slide along a second path parallel to said first path, said second slide member including a latch bar pivotally attached to said second slide member for latchingly engaging said retaining plate.

6. The tool according to claim 5 including at least first and second springs arranged to assist in the urging of said first and second slide members along said first and second paths in a first direction, respectively, so that said retaining plate is urged toward said cable guide surface.

7. The tool according to claim 6 including at least first and second screws arranged to assist in the urging of said first and second slide members along said first and second paths in a second direction which is opposite to said first direction, respectively, so that said retaining plate is urged away from said cable guide surface in opposition to said first and second springs.

8. The tool according to claim 5 wherein said retaining plate includes a latch tab and said latch bar includes a notch for engaging said latch tab for effecting said latching to said second end of said body.

9. The tool according to claim 4 wherein said body includes a first rectangular opening therein within which said first slide member is disposed in sliding engagement therewith, and wherein said body includes a second rectangular opening therein within which said second slide member is disposed in sliding engagement therewith.

10. The tool according to claim 4 wherein said body includes a first rectangular opening therein within which said first slide member is disposed in sliding engagement therewith, and wherein said body includes a second rectangular opening therein within which said second slide member is disposed in sliding engagement therewith.

11. A tool for aligning a ribbon cable to a connector for terminating thereto, comprising:

(a) a body having a longitudinal axis and first and second connector receiving cavities on opposite sides of said body, said first and second connector receiving cavities being dimensionally different in size from each other;

(b) a cable guide surface on said body having lateral guide means for laterally positioning said ribbon cable on said cable guide surface;

(c) a first locating surface adjacent one end of said first cavity arranged to position a receptacle connector therein with respect to said lateral guide means;

(d) a second locating surface adjacent one end of said second cavity arranged to position a second connector, dimensionally different in size from said first connector, therein with respect to said lateral guide means; and (e) a retaining plate coupled to said body arranged to urge a portion of said ribbon cable into aligned engagement with said cable guide surface so that said plurality of conductors are perpendicular to said longitudinal axis.

12. The tool according to claim 11 wherein said lateral guide means comprises a plurality of flutes formed in said cable guide surface.

13. A tool for aligning a ribbon cable to a connector for terminating thereto, comprising: (a) a body having first and second connector receiving cavities on opposite sides of said body;

(b) a cable guide surface on said body having lateral guide means comprising a plurality of flutes formed in said cable guide surface for laterally positioning said ribbon cable on said cable guide surface;

(c) a first locating surface adjacent one end of said first cavity arranged to position a receptacle connector therein with respect to said lateral guide means;

(d) a second locating surface adjacent one end of said second cavity arranged to position a second connector, different from said first connector, therein with respect to said lateral guide means; and (e) a retaining plate coupled to said body by means of a pivotal attachment to a first end of said body and a releasable latch for latching to a second end of said body and arranged to urge a portion of said ribbon cable into aligned engagement with said cable guide surface so that said plurality of conductors are perpendicular to said longitudinal axis.

14. The tool according to claim 13 wherein said pivotal attachment comprises a first slide member in sliding engagement with said body and arranged to slide along a first path perpendicular to said cable guide surface and a pin extending through a portion of said first slide member and a portion of said retaining plate.

15. The tool according to claim 14 wherein said releasable latch comprises a second slide member in sliding engagement with said body and arranged to slide along a second path parallel to said first path, said second slide member including a latch bar pivotally attached to said second slide member for latchingly engaging said retaining plate.

16. The tool according to claim 15 including at least first and second springs arranged to assist in the urging of said first and second slide members along said first and second paths in a first direction, respectively, so that said retaining plate is urged toward said cable guide surface.

17. The tool according to claim 16 including at least first and second screws arranged to assist in the urging of said first and second slide members along said first and second paths in a second direction which is opposite to said first direction, respectively, so that said retaining plate is urged away from said cable guide surface in opposition to said first and second springs.

18. The tool according to claim 15 wherein said retaining plate includes a latch tab and said latch bar includes a notch for engaging said latch tab for effecting said latching to said second end of said body.

19. A tool for aligning a ribbon cable to a connector for terminating thereto, comprising:

(a) a body having a longitudinal axis and first and second connector receiving cavities on opposite sides of said body;

(b) a cable guide surface on said body having lateral guide means comprising a plurality of flutes formed in said cable guide surface for laterally positioning said ribbon cable on said cable guide surface;

(c) a first locating surface adjacent one end of said first cavity arranged to position a receptacle connector therein with respect to said lateral guide means;

(d) a second locating surface adjacent one end of said second cavity arranged to position a second connector, different from said first connector, therein with respect to said lateral guide means;

(e) a retaining plate coupled to said body by means of a pivotal attachment to a first end of said body and a releasable latch for latching to a second end of said body and arranged to urge a portion of said ribbon cable into aligned engagement with said cable guide surface so that said plurality of conductors are perpendicular to said longitudinal axis; and (f) resilient means arranged to urge said retaining plate toward said cable guide surface.

20. A method of making a cable assembly comprising the steps of:

(1) providing an alignment tool having a fluted alignment surface for receiving and locating said ribbon cable, and first and second connector receiving cutouts on opposite sides of said fluted alignment surface, said tool including a retaining plate for releasably holding said ribbon cable in located engagement with said fluted alignment surface;

(2) positioning said ribbon cable in locating engagement with said fluted alignment surface;

(3) closing and latching said retaining plate so as to hold said ribbon cable in located engagement with said fluted alignment surface;

(4) aligning a first connector with the end of said ribbon cable and inserting said first connector into said first cutout and terminating said first connector to said ribbon cable;

(5) moving said ribbon cable longitudinally along said fluted alignment surface to a desired position while said retaining plate is holding said ribbon cable in said located engagement;

(6) aligning a second connector with another end of said ribbon cable and inserting said second connector into said second cutout and terminating said second connector to said ribbon cable; and (7) releasing said retaining plate and removing said ribbon cable from said alignment tool.

21. A method of making a cable assembly comprising the steps of:

(1) providing an alignment tool having a fluted alignment surface for receiving and locating said ribbon cable, and first and second connector receiving cutouts on opposite sides of said fluted alignment surface said tool including a retaining plate for releasably holding said ribbon cable in located engagement with said fluted alignment surface;

(2) positioning said ribbon cable in locating engagement with said fluted alignment surface;

(3) closing and latching said retaining plate so as to hold said ribbon cable in located engagement with said fluted alignment surface;

(4) aligning a first connector with the end of said ribbon cable and inserting said first connector into said first cutout and terminating said first connector to said ribbon cable:

(5) moving said ribbon cable longitudinally along said fluted alignment surface to a desired position while said retaining plate is holding said ribbon cable in said located engagement;

(6) aligning a third connector with an intermediate portion of said ribbon cable and inserting said third connector into one of said first and second cutouts and terminating said third connector to said ribbon cable;

(7) moving said ribbon cable longitudinally along said fluted alignment surface to a desired position while said retaining plate is holding said ribbon cable in said located engagement;

(8) aligning a second connector with the end of said ribbon cable and inserting said second connector into said second cutout and terminating said second connector to said ribbon cable; and (9) releasing said retaining plate and removing said ribbon cable from said alignment tool.

22. The method according to claim 21 wherein said terminating steps (4) (6) and (8) includes placing said alignment tool in a press having a movable ram and then cycling said ram to terminate said connector to said ribbon cable.

23. The method according to claim 22 wherein said inserting of said third connector into one of said first and second cutouts includes urging an end of said third connector against a locating edge or surface of said cutout, said urging continuing through said terminating of said third connector.

24. A method of making a cable assembly comprising the steps of:

(1) providing an alignment tool having a fluted alignment surface for receiving and locating said ribbon cable, and first and second connector receiving cutouts on opposite sides of said fluted alignment surface said tool including a retaining plate for releasably holding said ribbon cable in located engagement with said fluted alignment surface;

(2) positioning said ribbon cable in locating engagement with said fluted alignment surface;

(3) closing and latching said retaining plate so as to hold said ribbon cable in located engagement with said fluted alignment surface;

(4) aligning a first connector with the end of said ribbon cable and inserting said first connector into said first cutout and terminating said first connector to said ribbon cable;

(5) moving said ribbon cable longitudinally along said fluted alignment surface to a desired position while said retaining plate is holding said ribbon cable in said located engagement;

(6) aligning a second connector with the end of said ribbon cable and inserting said second connector into said second cutout and terminating said second connector to said ribbon cable; and (7) releasing said retaining plate and removing said ribbon cable from said alignment tool, wherein said inserting of said first and second connectors into said first and second cutouts, respectively, includes urging an end of each of said first and second connectors against a locating surface of each said respective cutout, said urging continuing through said terminating of each said first and second connectors.

25. A method of making a cable assembly comprising the steps of:

(1) providing an alignment tool having a fluted alignment surface for receiving and locating said ribbon cable, and first and second connector receiving cutouts on opposite sides of said fluted alignment surface said tool including a retaining plate for releasably holding said ribbon cable in located engagement with said fluted alignment surface;

(2) positioning said ribbon cable in locating engagement with said fluted alignment surface;

(3) closing and latching said retaining plate so as to hold said ribbon cable in located engagement with said fluted alignment surface;

(4) aligning a first connector with the end of said ribbon cable and inserting said first connector into said first cutout and terminating said first connector to said ribbon cable;

(5) moving said ribbon cable longitudinally along said fluted alignment surface to a desired position while said retaining plate is holding said ribbon cable in said located engagement;

(6) aligning a second connector with the end of said ribbon cable and inserting said second connector into said second cutout and terminating said second connector to said ribbon cable; and (7) releasing said retaining plate and removing said ribbon cable from said alignment tool, wherein said alignment tool includes set screws for adjusting the position of said retaining plate vertically with respect to said fluted alignment surface so that said ribbon cable can be moved longitudinally, through said flutes with resistance, and wherein step (2) includes the step of adjusting said set screws so that said ribbon cable is longitudinally movable yet remains square and accurately located with respect to said fluted alignment surface.

* * * * *